US011523970B1

(12) United States Patent
Vitello et al.

(10) Patent No.: US 11,523,970 B1
(45) Date of Patent: Dec. 13, 2022

(54) TAMPER EVIDENT SHIELD

(71) Applicants: Jonathan Vitello, Ft. Lauderdal, FL (US); Patrick Vitello, Pompano Beach, FL (US)

(72) Inventors: Jonathan Vitello, Ft. Lauderdal, FL (US); Patrick Vitello, Pompano Beach, FL (US)

( * ) Notice: Subject to any disclaimer, the term of this patent is extended or adjusted under 35 U.S.C. 154(b) by 81 days.

(21) Appl. No.: 17/006,294

(22) Filed: Aug. 28, 2020

(51) Int. Cl.
*A61J 1/14* (2006.01)

(52) U.S. Cl.
CPC ..... *A61J 1/1412* (2013.01); *A61J 1/1437* (2013.01)

(58) Field of Classification Search
CPC ..... A61J 1/1412; A61J 1/1437; A61J 9/08; A61M 5/1785; B65D 1/40
USPC ..... 604/111
See application file for complete search history.

(56) References Cited

U.S. PATENT DOCUMENTS

| | | | |
|---|---|---|---|
| 722,943 | A | 3/1903 | Chappell |
| 732,662 | A | 6/1903 | Smith |
| 1,678,991 | A | 7/1928 | Marschalek |
| 1,970,631 | A | 8/1934 | Sherman |
| 2,477,598 | A | 8/1949 | Hain |
| 2,739,590 | A | 3/1956 | Yochem |
| 2,823,674 | A | 2/1958 | Yochem |
| 2,834,346 | A | 5/1958 | Adams |
| 2,875,761 | A | 3/1959 | Helmer et al. |
| 2,888,015 | A | 5/1959 | Hunt |
| 2,952,255 | A | 9/1960 | Hein, Jr. |
| 3,122,280 | A | 2/1964 | Goda |
| 3,245,567 | A | 4/1966 | Knight |
| 3,323,798 | A | 6/1967 | Miller |
| 3,364,890 | A | 1/1968 | Andersen |
| 3,368,673 | A | 2/1968 | Johnson |
| 3,489,268 | A | 1/1970 | Meierhoefer |
| 3,574,306 | A | 4/1971 | Alden |
| 3,598,120 | A | 8/1971 | Mass |

(Continued)

FOREIGN PATENT DOCUMENTS

| | | |
|---|---|---|
| EP | 0148116 | 7/1985 |
| GB | 486367 | 6/1938 |

(Continued)

OTHER PUBLICATIONS

Arai Tsugio, Pilfering Proof Cap, Jan. 1, 1996.

*Primary Examiner* — Timothy L Maust
(74) *Attorney, Agent, or Firm* — Malloy and Malloy PL; Jennie Sue Malloy; Peter A. Matos

(57) ABSTRACT

A shield for a port closure of a medical container includes housing comprising two movably connected housing segments, each having a hollow interior and an open end, movable between open and closed orientations. A lock assembly is structured to define a fixed locked connection between the housing segments in the closed orientation and includes first and second lock members connected within different ones of the housing segments in a non-accessible location when the housing segments are in the closed orientation. A retainer is disposed within the housing in a capturing orientation relative to the closure therein, concurrent to the closed orientation. A latch assembly is connected to the housing segments and structured to retain said housing segments in said closed orientation, independently of and concurrently with the fixed locked connection of the lock assembly.

15 Claims, 5 Drawing Sheets

(56) References Cited

U.S. PATENT DOCUMENTS 3,610,241 A 10/1971 LeMarie
3,700,215 A 10/1972 Hardman et al.
3,706,307 A 12/1972 Hasson
3,712,749 A 1/1973 Roberts
3,726,445 A 4/1973 Ostrowsky et al.
3,747,751 A 7/1973 Miller et al.
3,850,329 A 11/1974 Robinson
3,872,867 A 3/1975 Killinger
3,904,033 A 9/1975 Haerr
3,905,375 A 9/1975 Toyama
3,937,211 A 2/1976 Merten
3,987,930 A 10/1976 Fuson
4,005,739 A 2/1977 Winchell
4,043,334 A 8/1977 Brown et al.
4,046,145 A 9/1977 Choksi et al.
4,068,696 A 1/1978 Winchell
4,216,585 A 8/1980 Hatter
4,216,872 A 8/1980 Bean
4,244,366 A 1/1981 Raines
4,252,122 A 2/1981 Halvorsen
4,271,972 A 6/1981 Thor
4,286,591 A 9/1981 Raines
4,286,640 A 9/1981 Knox et al.
4,313,539 A 2/1982 Raines
4,369,781 A 1/1983 Gilson et al.
4,420,085 A 12/1983 Wilson et al.
4,430,077 A 2/1984 Mittleman et al.
4,457,445 A * 7/1984 Hanks ..... G09F 3/0323 222/153.07
4,482,071 A 11/1984 Ishiwatari
D277,783 S 2/1985 Beck
4,521,237 A 6/1985 Logothetis
4,530,697 A 7/1985 Kuhlemann et al.
4,571,242 A 2/1986 Klien et al.
4,589,171 A 5/1986 McGill
4,664,259 A 5/1987 Landis
4,667,837 A 5/1987 Vitello et al.
4,676,530 A 6/1987 Nordgren et al.
4,693,707 A 9/1987 Dye
4,726,483 A 2/1988 Drozd
4,742,910 A 5/1988 Staebler
4,743,229 A 5/1988 Chu
4,743,231 A 5/1988 Kay et al.
4,760,847 A 8/1988 Vaillancourt
4,813,564 A 3/1989 Cooper et al.
4,832,695 A 5/1989 Rosenberg et al.
4,834,706 A 5/1989 Beck et al.
4,842,592 A 6/1989 Caggiani et al.
4,844,906 A 7/1989 Hermelin et al.
4,906,231 A 3/1990 Young
4,919,285 A 4/1990 Roof et al.
4,936,445 A 6/1990 Grabenkort
5,009,323 A 4/1991 Montgomery et al.
5,024,323 A 6/1991 Bolton
5,049,129 A 9/1991 Zdeb et al.
D323,392 S 1/1992 Bryne
5,085,332 A 2/1992 Gettig et al.
5,090,564 A 2/1992 Chimienti
5,135,496 A 8/1992 Vetter et al.
5,163,922 A 11/1992 McElveen, Jr. et al.
5,165,560 A 11/1992 Ennis, III et al.
5,230,429 A 7/1993 Etheredge, III
5,267,983 A 12/1993 Oilschlager et al.
5,292,308 A 3/1994 Ryan
5,293,993 A 3/1994 Yates, Jr. et al.
5,295,599 A 3/1994 Smith
5,312,367 A 5/1994 Nathan
5,312,368 A 5/1994 Haynes
5,328,466 A 7/1994 Denmark
5,328,474 A 7/1994 Raines
5,356,380 A 10/1994 Hoekwater et al.
5,370,226 A 12/1994 Gollobin et al.
5,380,295 A 1/1995 Vacca
5,402,887 A 4/1995 Shillington
5,405,339 A 4/1995 Kohnen et al.
5,456,668 A 10/1995 Ogle, II
5,458,580 A 10/1995 Hajishoreh
5,468,224 A 11/1995 Souryal
5,474,178 A 12/1995 DiViesti et al.
5,531,695 A 7/1996 Swisher
5,540,666 A 7/1996 Barta et al.
5,549,571 A 8/1996 Sak
5,558,648 A 9/1996 Shields
5,584,817 A 12/1996 van den Haak
5,588,239 A 12/1996 Anderson
5,617,954 A 4/1997 Kato et al.
5,624,402 A 4/1997 Imbert
5,662,233 A 9/1997 Reid
5,674,209 A 10/1997 Yarger
5,695,470 A 12/1997 Roussigne et al.
5,700,247 A 12/1997 Grimard et al.
5,702,374 A 12/1997 Johnson
5,713,485 A 2/1998 Lift et al.
5,776,124 A 7/1998 Wald
5,785,691 A 7/1998 Vetter et al.
5,797,885 A 8/1998 Rubin
5,807,343 A 9/1998 Tucker et al.
5,829,589 A 11/1998 Nguyen et al.
D402,766 S 12/1998 Smith et al.
5,883,806 A 3/1999 Meador et al.
5,884,457 A 3/1999 Ortiz et al.
5,902,269 A 5/1999 Jentzen
5,926,922 A 7/1999 Stottle
5,951,522 A 9/1999 Rosato et al.
5,951,525 A 9/1999 Thorne et al.
5,954,657 A 9/1999 Rados
5,957,166 A 9/1999 Safabash
5,957,314 A 9/1999 Nishida et al.
5,963,136 A 10/1999 O'Brien
5,989,227 A 11/1999 Vetter et al.
5,993,437 A 11/1999 Raoz
6,000,548 A 12/1999 Tsais
D419,671 S 1/2000 Jansen
6,021,824 A 2/2000 Larsen et al.
6,027,482 A 2/2000 Imbert
6,068,614 A 5/2000 Kimber et al.
D430,293 S 8/2000 Jansen
D431,864 S 10/2000 Jansen
6,126,640 A 10/2000 Tucker et al.
6,190,364 B1 2/2001 Imbert
6,193,688 B1 2/2001 Balestracci et al.
6,196,593 B1 3/2001 Petrick et al.
6,196,998 B1 3/2001 Jansen et al.
6,216,885 B1 4/2001 Guillaume
6,279,746 B1 4/2001 Hussaini et al.
6,235,376 B1 5/2001 Miyazaki et al.
6,280,418 B1 8/2001 Reinhard et al.
6,287,671 B1 9/2001 Bright et al.
6,322,543 B1 11/2001 Singh et al.
6,338,200 B1 1/2002 Baxa et al.
6,358,241 B1 3/2002 Shapeton et al.
6,375,640 B1 4/2002 Teraoka
6,394,983 B1 5/2002 Mayoral et al.
6,439,276 B1 8/2002 Wood et al.
6,485,460 B2 11/2002 Eakins et al.
6,500,155 B2 12/2002 Sasso
6,520,935 B1 2/2003 Jansen et al.
6,540,697 B2 4/2003 Chen
6,565,529 B1 5/2003 Kimber et al.
6,581,792 B1 6/2003 Limanjaya
6,585,691 B1 7/2003 Vitello
6,592,251 B2 7/2003 Edwards et al.
6,666,852 B2 12/2003 Niedospial, Jr.
6,682,798 B1 1/2004 Kiraly
6,726,652 B2 4/2004 Eakins et al.
6,726,672 B1 4/2004 Hanly et al.
6,764,469 B2 7/2004 Broselow
6,796,586 B2 9/2004 Werth
6,821,268 B2 11/2004 Balestracci
D501,549 S 2/2005 McAllister et al.
6,921,383 B2 7/2005 Vitello
6,935,560 B2 8/2005 Andreasson et al.
6,942,643 B2 9/2005 Eakins et al.
7,036,661 B2 5/2006 Anthony et al.

(56) References Cited

U.S. PATENT DOCUMENTS 7,055,273 B2 6/2006 Roshkoff
7,100,771 B2 9/2006 Massengale et al.
7,125,397 B2 10/2006 Woehr et al.
7,141,286 B1 11/2006 Kessler et al.
7,175,081 B2 2/2007 Andreasson et al.
7,182,256 B2 2/2007 Andreasson et al.
7,232,066 B2 6/2007 Anderasson et al.
7,240,926 B2 7/2007 Dalle et al.
7,299,981 B2 11/2007 Hickle et al.
7,374,555 B2 5/2008 Heinz et al.
7,404,500 B2 7/2008 Marteau et al.
7,410,803 B2 8/2008 Nollert et al.
7,425,208 B1 9/2008 Vitello
7,437,972 B2 10/2008 Yeager
7,482,166 B2 1/2009 Nollert et al.
7,497,330 B2 3/2009 Anthony et al.
7,503,453 B2 3/2009 Cronin et al.
7,588,563 B2 9/2009 Guala
7,594,681 B2 9/2009 DeCarlo
7,608,057 B2 10/2009 Woehr et al.
7,611,487 B2 11/2009 Woehr et al.
7,632,244 B2 12/2009 Buehler et al.
D608,900 S 1/2010 Giraud et al.
7,641,636 B2 1/2010 Moesli et al.
D612,939 S 3/2010 Boone, III et al.
7,681,606 B2 3/2010 Khan et al.
7,698,180 B2 4/2010 Fago et al.
7,735,664 B1 6/2010 Peters et al.
7,748,892 B2 7/2010 McCoy
7,762,988 B1 7/2010 Vitello
7,766,919 B2 8/2010 Delmotte
7,802,313 B2 9/2010 Czajka
7,886,908 B2 2/2011 Farrar et al.
7,918,830 B2 4/2011 Langan et al.
7,922,213 B2 4/2011 Werth
8,034,041 B2 10/2011 Domkowski et al.
8,079,518 B2 12/2011 Turner et al.
8,091,727 B2 1/2012 Domkowwski
8,118,788 B2 2/2012 Frezza
8,137,324 B2 3/2012 Bobst
8,140,349 B2 3/2012 Hanson et al.
8,252,247 B2 8/2012 Ferlic
8,257,286 B2 9/2012 Meyer et al.
8,328,082 B1 12/2012 Bochenko et al.
8,348,895 B1 1/2013 Vitello
8,353,869 B2 1/2013 Ranalletta et al.
8,413,811 B1 4/2013 Arendt
8,443,999 B1 5/2013 Reinders
D684,057 S 6/2013 Kwon
8,512,277 B2 8/2013 Del Vecchio
8,528,757 B2 9/2013 Bisio
8,556,074 B2 10/2013 Turner et al.
8,579,116 B2 11/2013 Pether et al.
8,591,462 B1 11/2013 Vitello
8,597,255 B2 12/2013 Emmott et al.
8,597,271 B2 12/2013 Langan et al.
8,616,413 B2 12/2013 Koyama
D701,304 S 3/2014 Lair et al.
8,672,902 B2 3/2014 Ruan et al.
8,702,674 B2 4/2014 Bochenko
8,777,910 B2 7/2014 Bauss et al.
8,777,930 B2 7/2014 Swisher et al.
8,852,561 B2 10/2014 Wagner et al.
8,864,021 B1 10/2014 Vitello
8,864,707 B1 10/2014 Vitello
8,864,708 B1 10/2014 Vitello
8,911,424 B2 12/2014 Weadock et al.
8,945,082 B2 2/2015 Geiger et al.
9,016,473 B2 4/2015 Tamarindo
9,082,157 B2 7/2015 Gibson
9,101,534 B2 8/2015 Bochenko
D738,495 S 9/2015 Strong et al.
9,125,976 B2 * 9/2015 Uber, III ..... G21F 5/018
D743,019 S 11/2015 Schultz
9,199,042 B2 12/2015 Farrar et al.
9,199,749 B1 12/2015 Vitello et al.
9,220,486 B2 12/2015 Schweiss et al.
9,220,577 B2 12/2015 Jessop et al.
D750,228 S 2/2016 Strong et al.
9,272,099 B2 3/2016 Limaye et al.
9,311,592 B1 4/2016 Vitello et al.
D756,777 S 5/2016 Berge et al.
9,336,669 B2 5/2016 Bowden et al.
D759,486 S 6/2016 Ingram et al.
D760,384 S 6/2016 Niunoya et al.
D760,902 S 7/2016 Persson
9,402,967 B1 8/2016 Vitello
9,427,715 B2 8/2016 Palazzolo et al.
9,433,768 B2 9/2016 Tekeste et al.
9,463,310 B1 10/2016 Vitello
D773,043 S 11/2016 Ingram et al.
D777,903 S 1/2017 Schultz
9,662,456 B2 5/2017 Woehr
D789,529 S 6/2017 Davis et al.
9,687,249 B2 6/2017 Hanlon et al.
9,744,304 B2 8/2017 Swift et al.
D797,928 S 9/2017 Davis et al.
D797,929 S 9/2017 Davis et al.
9,764,098 B2 9/2017 Hund et al.
9,821,152 B1 11/2017 Vitello et al.
D806,241 S 12/2017 Swinney et al.
D807,503 S 1/2018 Davis et al.
9,855,191 B1 * 1/2018 Vitello ..... A61J 1/18
D815,945 S 4/2018 Fischer
9,987,438 B2 6/2018 Stillson
D825,746 S 8/2018 Davis et al.
10,039,913 B2 8/2018 Yeh et al.
D831,201 S 10/2018 Holtz et al.
D834,187 S 11/2018 Ryan
10,124,122 B2 11/2018 Zenker
10,166,343 B1 1/2019 Hunt et al.
10,166,347 B1 1/2019 Vitello
10,183,129 B1 1/2019 Vitello
10,207,099 B1 2/2019 Vitello
D842,464 S 3/2019 Davis et al.
D847,373 S 4/2019 Hurwit et al.
10,300,263 B1 5/2019 Hunt
10,307,548 B1 6/2019 Hunt et al.
10,315,024 B1 6/2019 Vitello et al.
10,315,808 B2 6/2019 Taylor et al.
10,376,655 B2 8/2019 Pupke et al.
D859,125 S 9/2019 Weagle et al.
10,478,262 B2 11/2019 Niese et al.
10,758,684 B1 9/2020 Vitello et al.
10,773,067 B2 9/2020 Davis et al.
10,888,672 B1 1/2021 Vitello
10,898,659 B1 1/2021 Vitello et al.
10,912,898 B1 2/2021 Vitello et al.
10,933,202 B1 3/2021 Banik
10,953,162 B1 3/2021 Hunt et al.
11,040,149 B1 6/2021 Banik
11,040,154 B1 6/2021 Vitello et al.
11,097,071 B1 8/2021 Hunt et al.
11,278,681 B1 3/2022 Banik et al.
D948,713 S 4/2022 Banik
11,357,588 B1 6/2022 Vitello et al.
11,413,406 B1 8/2022 Vitello et al.
11,426,328 B1 8/2022 Ollmann et al.
2001/0034506 A1 10/2001 Hirschman et al.
2001/0056258 A1 12/2001 Evans
2002/0007147 A1 1/2002 Capes et al.
2002/0023409 A1 2/2002 Py
2002/0046962 A1 4/2002 Vallans et al.
2002/0097396 A1 7/2002 Schafer
2002/0099334 A1 7/2002 Hanson et al.
2002/0101656 A1 8/2002 Blumenthal et al.
2002/0104770 A1 8/2002 Shapeton et al.
2002/0133119 A1 9/2002 Eakins et al.
2003/0055685 A1 3/2003 Cobb et al.
2003/0146617 A1 8/2003 Franko, Sr.
2003/0183547 A1 10/2003 Heyman
2004/0008123 A1 1/2004 Carrender et al.
2004/0064095 A1 4/2004 Vitello
2004/0116858 A1 6/2004 Heinz et al.

(56) References Cited

U.S. PATENT DOCUMENTS

| | | | |
|---|---|---|---|
| 2004/0186437 | A1 | 9/2004 | Frenette et al. |
| 2004/0225258 | A1 | 11/2004 | Balestracci |
| 2005/0146081 | A1 | 7/2005 | MacLean et al. |
| 2005/0148941 | A1 | 7/2005 | Farrar et al. |
| 2005/0209555 | A1 | 9/2005 | Middleton et al. |
| 2006/0084925 | A1 | 4/2006 | Ramsahoye |
| 2006/0089601 | A1 | 4/2006 | Dionigi |
| 2006/0173415 | A1 | 8/2006 | Cummins |
| 2006/0189933 | A1 | 8/2006 | Alheidt et al. |
| 2007/0060898 | A1 | 3/2007 | Shaughnessy et al. |
| 2007/0106234 | A1 | 5/2007 | Klein |
| 2007/0142786 | A1 | 6/2007 | Lampropoulos et al. |
| 2007/0191690 | A1 | 8/2007 | Hasse et al. |
| 2007/0219503 | A1 | 9/2007 | Loop et al. |
| 2007/0257111 | A1 | 11/2007 | Ortenzi |
| 2008/0068178 | A1 | 3/2008 | Meyer |
| 2008/0097310 | A1 | 4/2008 | Buehler et al. |
| 2008/0106388 | A1 | 5/2008 | Knight |
| 2008/0140020 | A1 | 6/2008 | Shirley |
| 2008/0243088 | A1 | 10/2008 | Evans |
| 2008/0303267 | A1 | 12/2008 | Schnell et al. |
| 2008/0306443 | A1 | 12/2008 | Neer |
| 2009/0084804 | A1 | 4/2009 | Caspary et al. |
| 2009/0099552 | A1 | 4/2009 | Levy et al. |
| 2009/0149815 | A1 | 6/2009 | Kiel et al. |
| 2009/0166311 | A1 | 7/2009 | Claessens |
| 2009/0326481 | A1 | 12/2009 | Swisher et al. |
| 2010/0084403 | A1 | 4/2010 | Popish et al. |
| 2010/0126894 | A1 | 5/2010 | Koukol et al. |
| 2010/0179822 | A1 | 7/2010 | Reppas |
| 2010/0228226 | A1 | 9/2010 | Nielsen |
| 2010/0252564 | A1 | 10/2010 | Martinez et al. |
| 2010/0283238 | A1 | 11/2010 | Deighan et al. |
| 2011/0044850 | A1 | 2/2011 | Solomon et al. |
| 2011/0046550 | A1 | 2/2011 | Schiller et al. |
| 2011/0046603 | A1 | 2/2011 | Felsovalyi et al. |
| 2012/0064515 | A2 | 3/2012 | Knapp et al. |
| 2012/0096957 | A1 | 4/2012 | Ochman |
| 2012/0110950 | A1 | 5/2012 | Schraudolph |
| 2013/0018356 | A1 | 1/2013 | Prince et al. |
| 2013/0056130 | A1 | 3/2013 | Alpert et al. |
| 2013/0088354 | A1 | 4/2013 | Thomas |
| 2013/0237949 | A1 | 9/2013 | Miller |
| 2013/0269592 | A1 | 10/2013 | Heacock et al. |
| 2014/0000781 | A1 | 1/2014 | Franko, Jr. |
| 2014/0034536 | A1 | 2/2014 | Reinhardt et al. |
| 2014/0069202 | A1 | 3/2014 | Fisk |
| 2014/0069829 | A1 | 3/2014 | Evans |
| 2014/0135738 | A1 | 5/2014 | Panian |
| 2014/0155868 | A1 | 6/2014 | Nelson et al. |
| 2014/0163465 | A1 | 6/2014 | Bartlett, II et al. |
| 2014/0257843 | A1 | 9/2014 | Adler et al. |
| 2014/0326727 | A1 | 11/2014 | Jouin et al. |
| 2014/0353196 | A1 | 12/2014 | Key |
| 2015/0182686 | A1 | 7/2015 | Okihara |
| 2015/0191633 | A1 | 7/2015 | De Boer et al. |
| 2015/0246185 | A1 | 9/2015 | Heinz |
| 2015/0302232 | A1 | 10/2015 | Strassburger et al. |
| 2015/0305982 | A1 | 10/2015 | Bochenko |
| 2015/0310771 | A1 | 10/2015 | Atkinson et al. |
| 2016/0067422 | A1 | 3/2016 | Davis et al. |
| 2016/0090456 | A1 | 3/2016 | Ishimaru et al. |
| 2016/0136352 | A1 | 5/2016 | Smith et al. |
| 2016/0144119 | A1 | 5/2016 | Limaye et al. |
| 2016/0158110 | A1 | 6/2016 | Swisher et al. |
| 2016/0158449 | A1 | 6/2016 | Limaye et al. |
| 2016/0176550 | A1 | 6/2016 | Viitello et al. |
| 2016/0250420 | A1 | 9/2016 | Maritan et al. |
| 2016/0279032 | A1 | 9/2016 | Davis |
| 2016/0328586 | A1 | 11/2016 | Bowden et al. |
| 2016/0361235 | A1 | 12/2016 | Swisher |
| 2016/0367439 | A1 | 12/2016 | Davis et al. |
| 2017/0007771 | A1 | 1/2017 | Duinat et al. |
| 2017/0014310 | A1 | 1/2017 | Hyun et al. |
| 2017/0124289 | A1 | 5/2017 | Hasan et al. |
| 2017/0173321 | A1 | 6/2017 | Davis et al. |
| 2017/0203086 | A1 | 7/2017 | Davis |
| 2017/0225843 | A1 | 8/2017 | Glaser et al. |
| 2017/0239141 | A1 | 8/2017 | Davis et al. |
| 2017/0319438 | A1 | 11/2017 | Davis et al. |
| 2017/0354792 | A1 | 12/2017 | Ward |
| 2018/0001540 | A1 | 1/2018 | Byun |
| 2018/0014998 | A1 | 1/2018 | Yuki et al. |
| 2018/0078684 | A1 | 3/2018 | Peng et al. |
| 2018/0089593 | A1 | 3/2018 | Patel et al. |
| 2018/0098915 | A1 | 4/2018 | Rajagopal et al. |
| 2019/0388626 | A1 | 12/2019 | Okihara |
| 2022/0008645 | A1 | 1/2022 | Ukai et al. |

FOREIGN PATENT DOCUMENTS

| | | |
|---|---|---|
| JP | 08002544 | 1/1996 |
| KR | 101159987 | 6/2012 |
| WO | WO2008000279 | 1/2008 |
| WO | WO2017086607 | 5/2015 |

* cited by examiner

TAMPER EVIDENT SHIELD

BACKGROUND OF THE INVENTION

Field of the Invention

The present invention is directed to a tamper evident shield for a closure of a container. The shield is specifically, but not exclusively, structured to enclose an additive port closure of an IV bag.

Description of the Related Art

In numerous medical care facilities, it is common practice to administer various medications to a patient either orally or by injection. As a result, a number of syringes, IV bags, medication carrying containers, etc. may be pre-loaded within or supplied to the medical care facility and subsequently stored at different locations or stations throughout the facility. At large medical facilities, preloaded syringes or other administering containers may be delivered to multiple nurses' stations. Because of the remote location of many nurse's stations, a pre-loaded syringe is very often given to other personnel for delivery or subsequent dosing of the patient by a duly qualified nurse or other medically trained person.

Also, in the case of a very expensive drug or an addictive type drug such as, but not limited to, morphine, there is a danger that the pre-loaded container will be tampered with at some point, by a person seeking to improperly gain unauthorized access to the drug. This possibility can present real danger when unauthorized access to the contents of the preloaded syringe, IV bag or other container is accomplished. One possible outcome of such a situation includes the inappropriate substitution of some other, unauthorized material in the syringe or container. By way of an example only, if saline solution were substituted for a dose of morphine, this could have extremely serious consequences. Thus, there is a problem of determining if a sealed, preloaded medication container has, or has not, been exposed to contamination or might otherwise have been compromised by it being tampered with. This and related types of problems have been described in one of the inventors herein own previously granted U.S. Pat. No. 4,667,837.

However, certain problems remain in the relevant field of art, despite the introduction of products represented in the above noted patent. Such problems are related to the manufacturing thereof in a manner which is relatively easy and inexpensive, as well as some problems involved with the assembly and placement of a protective, tamper evident structure onto a drug loaded container. Also, additional problems relate to the maintenance of sterility during storage at the manufacturing facility and during transport to and throughout the various medical facilities where they are used. Accordingly, the present invention seeks to address such problems and others associated with the handling of protective shields, end caps, closures, etc. used with medication administering or storage containers during their manufacture, assembly, and administration.

Therefore, there is a need in this area for an improved, tamper evident shield which is capable of being used with standard or conventional pre-loaded medical administering and/or storage containers in a manner which overcomes problems and or disadvantages of the type set forth above. If any such improved tamper evident shield was developed, it would preferably have appropriate and advantageous structural and operative features, which could include, but are not be limited to, an integral or one-piece construction which facilitates appropriate connection to or mounting on a preloaded medication container. In addition, if any such improved and proposed tamper evident shield were developed, it would preferably also be structured to provide a clear and unmistakable indication of tampering or previous attempted access to the contents of the medical container.

Further, the structuring of any such proposed tamper evident shield should prevent the opening thereof, thereby restricting access to a conventional or customized closure secured to the port of the medical container. Any such preventive, tamper evident structuring may require partial destruction of the shield or perhaps a complete destruction of it to provide clear evidence of an attempted tampering. Finally, if any such improved tamper evident shield were developed, it should be structurally and operatively reliable, while capable of quick and easy attachment thereof in a shielding, protecting position relative to the closure operatively associated with the port of the medical container.

SUMMARY OF THE INVENTION

The present invention is directed to a shield including a housing which is fixedly disposable in surrounding, access restricting relation to a closure of the type connected in flow restricting relation to a flow port of a medical container. As used herein, the term "closure" is meant to be interpreted broadly. Therefore, "closure" is meant to include any of a plurality of stoppers, closing devices and/or flow restricting structures intended, at least initially, to restrict access to the interior of a corresponding container or flow port thereof.

Moreover, in hospital pharmacies and outsourced pharmacy compounding facilities, IV bag preparations are becoming more and more common. Also, there is a significant increase in different manufacturers entering the market and producing various types of IV bags and closures therefore. While the IV tube set connections for the ports are standardized, the medication port or additive port thereof varies in size, shape and material. Additive port caps or closures provide tamper evidence and visual indication to the clinician that indicates whether or not medication has been added to the IV bag. Currently, these additive port closures are specifically designed to be compatible with a single brand of bags using the same additive port design.

To overcome problems associated therewith, the present invention is directed to a shield having a robust dimension, configuration and overall structure that is compatible with any brand of IV bag and their various additive port designs and closure structures. Further, the shield of the present invention is structured to include tamper evident capabilities.

In a more specific terms, the shield of the present invention includes a housing comprising two housing segments hinged or pivotally connected together along correspondingly disposed longitudinal sides. As such, the housing segments are selectively disposable between an open orientation and a closed orientation. The hinged connection between two housing segments may include, but is not limited to, a "living hinge". Further, each of the housing segments includes an at least partially hollow interior which, when the housing segments are in the closed orientation, define the substantially hollow interior of the housing. When the housing is operatively attached in enclosing retaining relation to the flow restricting closure of an IV bag or other medical container, the closure is captured therein.

As explained in greater detail hereinafter, tamper evident features of the shield are at least partially demonstrated by preventing the removal of the shield from its surrounding protective position relative to the closure. More specifically, once the shield is forcibly removed from the port of the IV bag or other container, the closure will also be removed from the container port and be captured within the interior of the housing in a non-accessible location. As a result, the closure cannot be accessed for reattachment to the medical device. Therefore, in at least one embodiment, once the two housing segments are disposed in the closed orientation the provision of a lock assembly in cooperation with a latch assembly will prevent a separation of the two housing segments into an open orientation. The removal of the closure from the interior of the housing will thereby be prevented unless a breakage, rupture, or other type destruction of all or part of the housing is accomplished.

It is also of note that the housing segments and other portions of the housing are formed of a sufficiently high strength plastic material to resist breakage, rupture, puncture, cutting, etc. Also, such high strength plastic material is at least minimally flexible. Therefore, the destruction or damage required to open the housing and/or separate the housing segments will be sufficiently severe to prevent reconnection of the two housing segments in the closed orientation. As a result, the opening of or access to the container port, in an attempt to access the contents of the container cannot be accomplished without forced removal of the shield from the closure and additive port thereof. This in turn will result in the capture of the closure within the housing, as the housing is removed from the port of the container. As set forth above, the removal of the shield/housing will result in a concurrent removal of the closure and the capturing of the closure within the housing in a non-accessible location. Accordingly, clear evidence of tampering or attempted access to the container contents and/or closure will be evident.

As indicated, the housing of the shield includes a lock assembly, operative to fixedly secure the two housing segments in the closed orientation, on a permanent basis, absent destruction or damage to the housing of the shield. The lock assembly is at least partially connected to each of the housing segments within the corresponding hollow interiors thereof. Therefore, the lock assembly is disposed in a non-accessible location within the interior of the housing, when the housing segments are in the closed orientation. As used herein, the term "fixedly secured" and its equivalent is meant to describe the permanent attachment or connection of the housing segments to one another in the closed orientation, wherein opening of the closure can only be accomplished by the described damage or at least partial destruction of the housing. Due to this "fixedly secured" feature of the lock assembly and the permanent disposition of the housing segments in the closed orientation, access to the lock assembly for the purpose of "unlocking" it, will be significantly restricted. Any attempt to open or separate the housing segments in order to access the lock assembly, once fixedly secured in the closed orientation, will result in the complete or partial destruction of the housing, as set forth above, and render it inoperative for further use or reuse.

Structural and operative features of the lock assembly include the provision of a first lock member and a second lock member each connected on the interior of different ones of the two housing segments and extending at least partially outward therefrom. Moreover, each of the first and second lock members is movable with their respective housing segments between the open and closed orientations. Further, the first and second lock members are disposed in cooperative, but at least partially offset alignment with one another, relative to the length of the housing and the corresponding housing segments. Such an offset alignment, once disposed in the closed orientation, will result in the disposition of the first and second lock members into a coaxially aligned, locking engagement, wherein corresponding surfaces thereof may be disposed in confronting relation to one another.

As explained in greater detail hereinafter, when the housing is in the closed orientation it includes one open end, or access opening, as well as an oppositely disposed closed end. The closed end of the housing is at least partially defined by a base connected to one of the housing segments. As such, the base also at least partially defines a closed-end of the housing segment to which it is attached. Further, when the housing segments are in the closed orientation the base is disposed, dimensioned and configured to overlie or cover a corresponding end of the other housing segment, to which it is not attached. In addition, the base is cooperatively disposed and structured with the lock assembly to provide a stabilizing influence thereon, when the housing segments are in the closed orientation.

More specifically, in at least one preferred embodiment the base and the first lock member are fixedly connected to a common one of the housing segments such that a predetermined axial/longitudinal space exists therebetween. The second lock member is connected to the other of the housing segments and when the housing segments are moved into the closed orientation, the second lock member passes into the predetermined space between the base and the first lock member. This predetermined space is cooperatively and/or correspondingly dimensioned relative to the thickness of the second lock member to facilitate the receipt of the second lock member within the predetermined space as the housing segments move into the closed orientation. As a result, the second lock member is concurrently disposed in locking engagement and/or connection with the first lock member and in substantially stabilized, possibly confronting relation with and between both the base and the first lock member.

Therefore, due to the cooperative dimensioning of the predetermined space and the thickness of the second lock member, stabilization of the second lock member can be accurately described as preventing or at least restricting movement of the second lock member, when disposed within the predetermined space. As a result of such stabilization and/or restricted movement of the second lock member within the predetermined space, inadvertent or purposeful disconnection of the aforementioned locking connection or locking engagement between the first and second lock members, will be restricted. In addition, the restricted movement of the second lock member within the predetermined space will also facilitate an accurate alignment between the two housing segments. In turn, portions of the aforementioned latch assembly will be accurately aligned to move into a latched orientation with one another, as the two housing segments move from the open orientation into the closed orientation.

In addition, the non-accessible location of the lock assembly on the interior of the housing is further enhanced by the location of the first and second lock members disposed in longitudinally spaced relation to the closed end or base of the housing, when in the closed orientation. Moreover, each of the first and second lock members are fixedly connected to the hollow interiors of different ones of the housing segments and are disposed and dimensioned to extend at least partially outward therefrom in transverse relation to the length of the corresponding housing segments and/or the longitudinal sides thereof.

Therefore, when the housing is in the closed orientation, the open end of each of the housing segments collectively define the access opening of the housing. The access opening is dimensioned and disposed to receive the container port while the container port is disposed at least partially within the interior of the housing in attached relation to the port closure. As should be apparent, the hinged or pivotal connection between the housing segments, define a "clamshell" configuration/structure, which facilitates the container port and attached closure being inserted within the interior of the housing, while the housing segments are in the open orientation. When so inserted, disposition of the housing segments in the closed orientation will result in capture of the closure within the housing and an at least partially concurrent enclosure of the container port, to which the closure is attached.

The structural features of the housing also include a retaining assembly disposed at least partially within the hollow interior of at least one of the housing segments but preferably and possibly more practically within the hollow interiors of both of the two housing segments. As such, the retaining assembly includes at least one but preferably at least two retaining flanges or flange segments. Each of the at least two retaining flanges is integrally or otherwise fixedly secured to the interior surface of the hollow interior of different ones of the housing segments. Further, in at least one embodiment, the retaining flanges extend transversely outward from the respective interior surfaces into aligned, substantially mating and/or co-planar, confronting relation to one another.

The dimension and configuration of the flange segments are such as to form a substantially central opening or aperture extending through the mated and/or confronting retaining flange segments. This retaining opening or aperture is dimensioned in accord with the dimension of the closure and/or port of the container connected to the closure being shielded. More specifically, once the two housing segments are disposed in the closed orientation, the closure is captured between the mating or confronting retaining flanges and an end of the housing opposite to the access opening.

Yet additional structural features of the two retaining flange include the inner peripheral edge thereof having an irregular surface configuration. This irregular surface configuration may be defined by a plurality of teeth extending along the length of the inner peripheral edge so as to be disposed in at least partially confronting relation to a corresponding portion of the container port, to which the closure is attached. The plurality of teeth or other irregular surface configuration may be structured to provide a gripping engagement and/or retaining relation with the container port. As such, a forced removal of the shield and/or housing would result in possible damage to the container port due to interaction with the plurality of teeth or other irregular surface configuration, as it extends along the inner peripheral edges of at least one but preferably both of the retaining flanges.

Therefore, the captured disposition of the closure, is at least partially accomplished by the retaining opening or aperture having a smaller transverse dimension or diameter than that of the closure. As a result, passage of the closure through the retaining aperture and out of the access opening of the housing, once the housing segments are in the closed orientation, is prevented. As a result, any attempt to remove the housing from the closure or container port to which it is attached, will result in a removal of the closure from the port of the container and the capture of the closure within the closed housing. As a result, the closure, once captured within the interior of the housing, will be non-accessible due to the two housing segments being fixedly secured in the closed orientation. This non-accessible disposition of the closure will also be due to one end of the housing being closed and the closure not being able to pass through the retaining opening or aperture in the retaining assembly.

Additional structural and operative features of one or more preferred embodiments of the shield include the provision of a latch assembly mounted on or connected to the free longitudinal sides of each of the two housing segments. As such, the latch assembly is at least partially disposed on the exterior of the housing and comprises one or more cooperatively structured latch structures, which serve to retain the two housing segments in the closed orientation. Accordingly, the shield may include both the interior, non-accessible lock assembly, as described above, as well as the provision of an additional latch assembly. Moreover, the latch assembly is structured to independently restrict opening or separation of the two housing segments into the open orientation once disposed in the closed orientation.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 5:
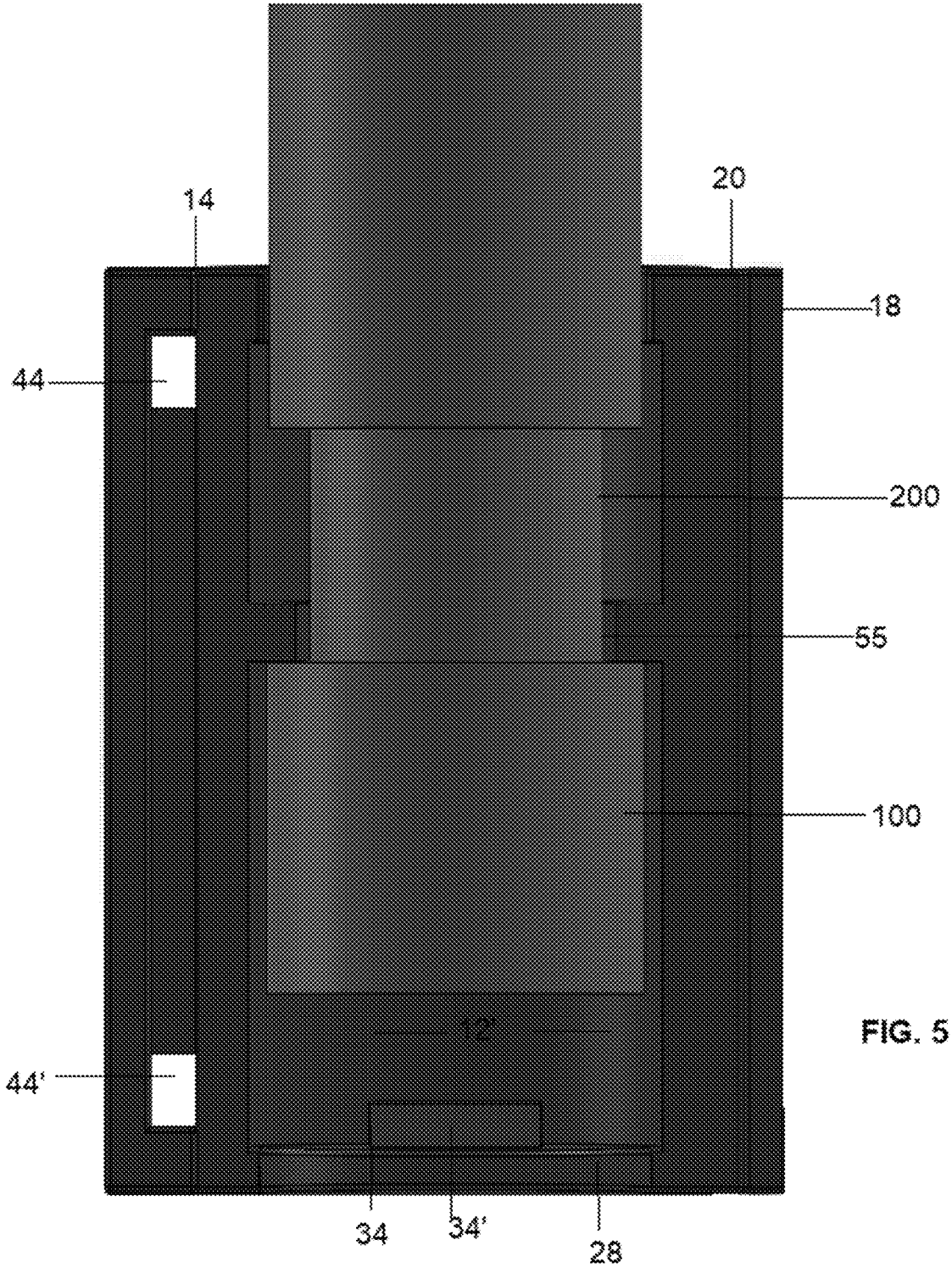
FIG. 5 is an interior longitudinal sectional view, in schematic form, of a container port and connected closure of a medical container, in a protected, shielded position within the shield of the embodiment of FIGS. 1-4, when in a closed orientation.

As represented throughout the Figures, the present invention is directed to a shield 10 including a housing generally indicated as 12. As schematically represented in FIG. 5, the shield 10 and the housing 12, when in a closed orientation is fixedly secured in surrounding, access restricting relation to a closure 100 of the type connected in flow restricting relation to a flow port 200 of a medical container such as, but not limited to, an IV bag.

Figure 1:
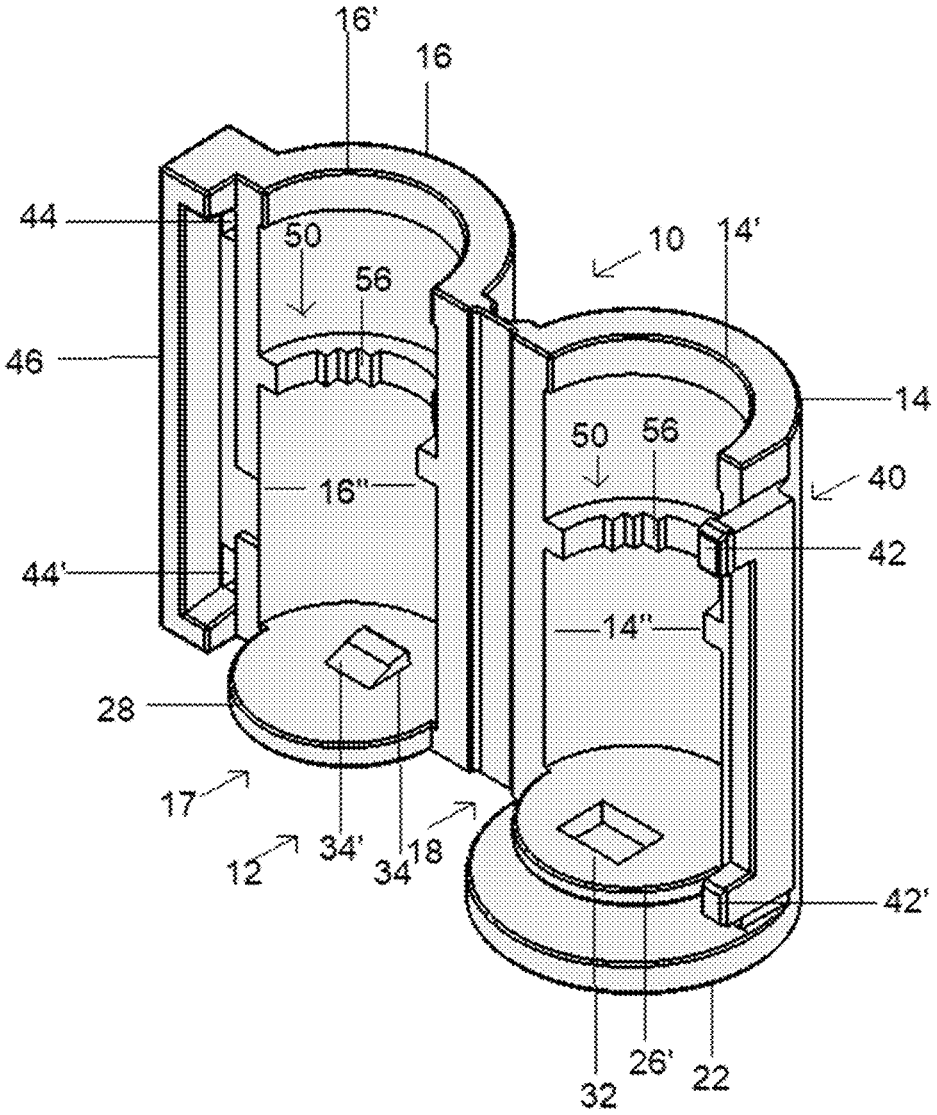
FIG. 1 is a perspective view of the tamper evident shield of the present invention in an open orientation.
Figure 2:
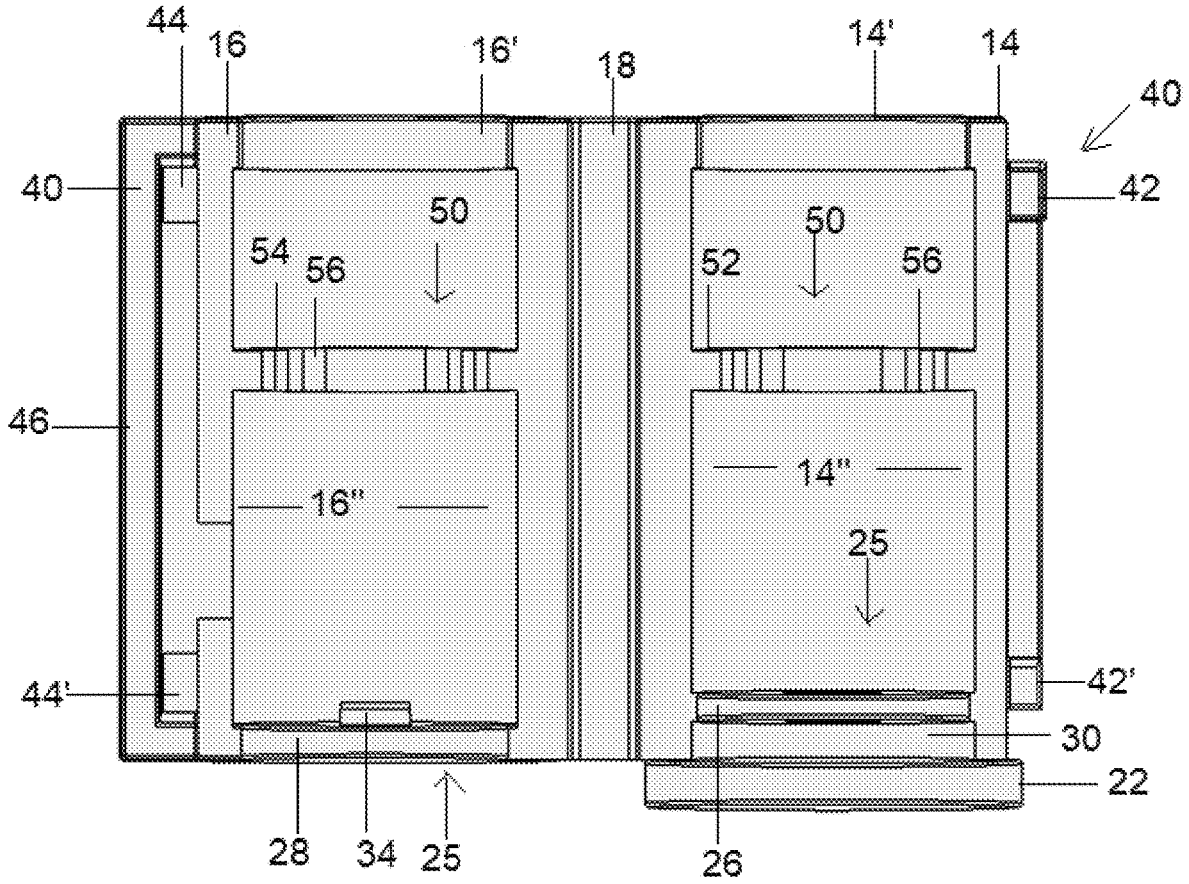
FIG. 2 is a front elevation view of the embodiment of the shield as represented in FIG. 1 in an open orientation.
Figure 3:
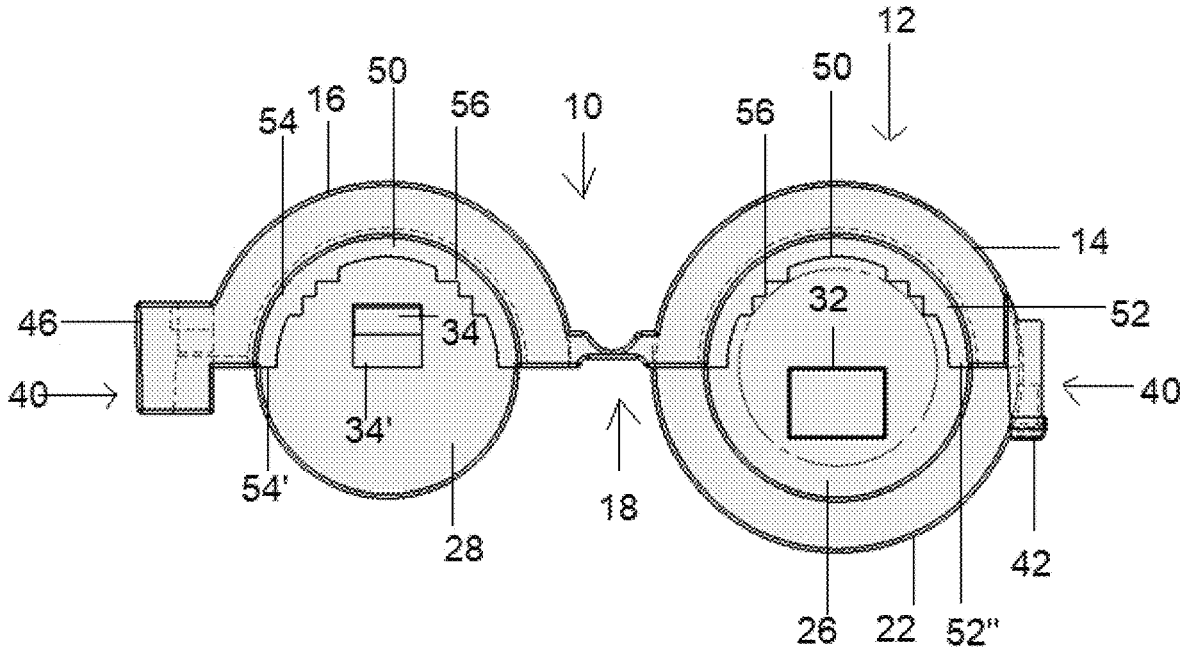
FIG. 3 is a top plan view of the embodiment of FIGS. 1 and 2 in an open orientation.

More specifically, the housing 12 comprises two housing segments 14 and 16 movably connected to one another preferably by a "living hinge", generally indicated as 18. As such, the two housing segments 14 and 16 are selectively disposable from an open orientation, as represented in FIGS. 1-3, into a closed orientation, as at least partially represented in FIG. 4 and represented in schematic form in FIG. 5. As should be apparent, the living hinge 18 allows pivotal movement of the housing segments 14 and 16 relative to one another so as to facilitate the aforementioned disposition from the open orientation into the closed orientation.

Each of the housing segments 14 and 16 include an open end 14' and 16' which collectively define an access opening 20 of the housing 12, when the housing segments 14 and 16 are in the closed orientation. Further, each of the housing segments 14 and 16 include an at least partially hollow interior 14" and 16", to define a hollow interior 12' of the housing 12 when the housing segments 14 and 16 are in the closed orientation.

As also clearly represented, each of the housing segments 14 and 16 include a closed or at least partially obstructed end oppositely disposed to the respective open ends 14' and 16'. More specifically, housing segment 14 includes a base 22 extending outwardly from the hollow interior 14", in transverse relation to the length of the housing segment 14. Moreover, the base 22 is disposed, dimensioned and configured to be disposed in covering relation to the corresponding end 17 of the housing segment 16, which is opposed to the open end 16' thereof. As such, the base 22 may be disposed to at least partially define a closed and of the housing 12 when the housing segments 14 and 16 are in the closed orientation. Therefore, the disposition of the base 22 in closing, covering and/or at least partially mating relation to the corresponding end 17 of the housing segment 16 can be accurately described as a closed end of the housing 12.

Another structural and operative feature of the housing 12 includes a lock assembly 25, operative to fixedly secure the two housing segments 14 and 16 in the closed orientation. As such, the housing segments 14 and 16 are fixedly secured on a permanent basis, absent destruction or damage to the housing 12. The lock assembly 25 comprises two lock members 26 and 28 each integrally or fixedly connected to the housing segments 14 and 16 respectively. Each of the lock members 26 and 28 are disposed within the corresponding hollow interiors 14' and 16' and extend transversely outward there from. Therefore, the lock assembly 25 is disposed in a non-accessible location within the interior of the housing 12, when the housing segments 14 and 16 are in the closed orientation. It will also be noted that second lock member 28 is disposed in covering relation to the end 17 of the housing segment 16 and may thereby define the closed end thereof.

Therefore, the substantially permanent attachment or fixedly secured relation of the housing segments 14 and 16 prevent the opening of the housing 12 without breakage, rupture, damage, or at least partial destruction of the housing 12. Due to this "fixedly secured" operative feature of the lock assembly 25 and the permanent disposition of the housing segments in the closed orientation, access to the lock assembly 25 for the purpose of "unlocking" it will be prevented or at least significantly restricted. Any attempt to open or separate the housing segments 14 and 16 in order to access the lock assembly 25, once fixedly secured in the closed orientation, will result in the complete or partial destruction of the housing, as set forth above, and render it inoperative for further use or reuse.

Also, in at least one preferred embodiment the base 22 and the first lock member 26 are fixedly connected to a common one of the housing segments 14 such that a predetermined axial/longitudinal space 30 exists therebetween. The second lock member 28, being connected to the other of the housing segments 16, passes into the predetermined space 30 between the base 22 and the first lock member 26, as at least partially represented in FIG. 4. This predetermined space 30 is cooperatively and/or correspondingly dimensioned relative to the thickness of the second lock member 28 to facilitate the receipt of the second lock member 28 within the predetermined space 30 as the housing segments 14 and 16 move into the closed orientation, as at least partially represented in FIG. 4. As a result, the second lock member 28 is concurrently disposed in locking engagement and/or connection with the first lock member 26 and in substantially stabilized, coaxially aligned and possibly confronting relation with and between both the base 22 and the first lock member 26.

As a result, such stabilization and/or restricted movement of the second lock member 28 within the predetermined space 30, will serve to prevent inadvertent or purposeful disconnection of the aforementioned locking connection or locking engagement between the first and second lock members 26 and 28. In addition, the restricted movement of the second lock member 28 within the aforementioned predetermined space 30 will also facilitate an accurate alignment between the two housing segments 14 and 16. In turn, portions of a latch assembly generally indicated 40 will be accurately aligned to move into a latched orientation with one another, as the two housing segments 14 and 16 move from the open orientation into the closed orientation, as described in greater detail hereinafter.

Additional structural features of the lock assembly 25 which facilitates the substantially permanent, fixed securement of the housing segments 14 and 16 with one another includes locking components 32 and 34 each integrally or fixedly formed, mounted or disposed on different ones of the first and second lock members 26 and 28. In more specific terms, locking component 32 is in the form of an opening, aperture, recess etc. formed in the first lock member 26. In cooperation therewith, the locking component 34 is in the form of an outwardly projecting member having a ramp configuration or construction 34'. The ramp construction 34' and a remaining portion of the locking component 34 is cooperatively disposed, dimensioned and configured to be received in locking engagement within the opening or aperture of the locking component 32.

Figure 4:
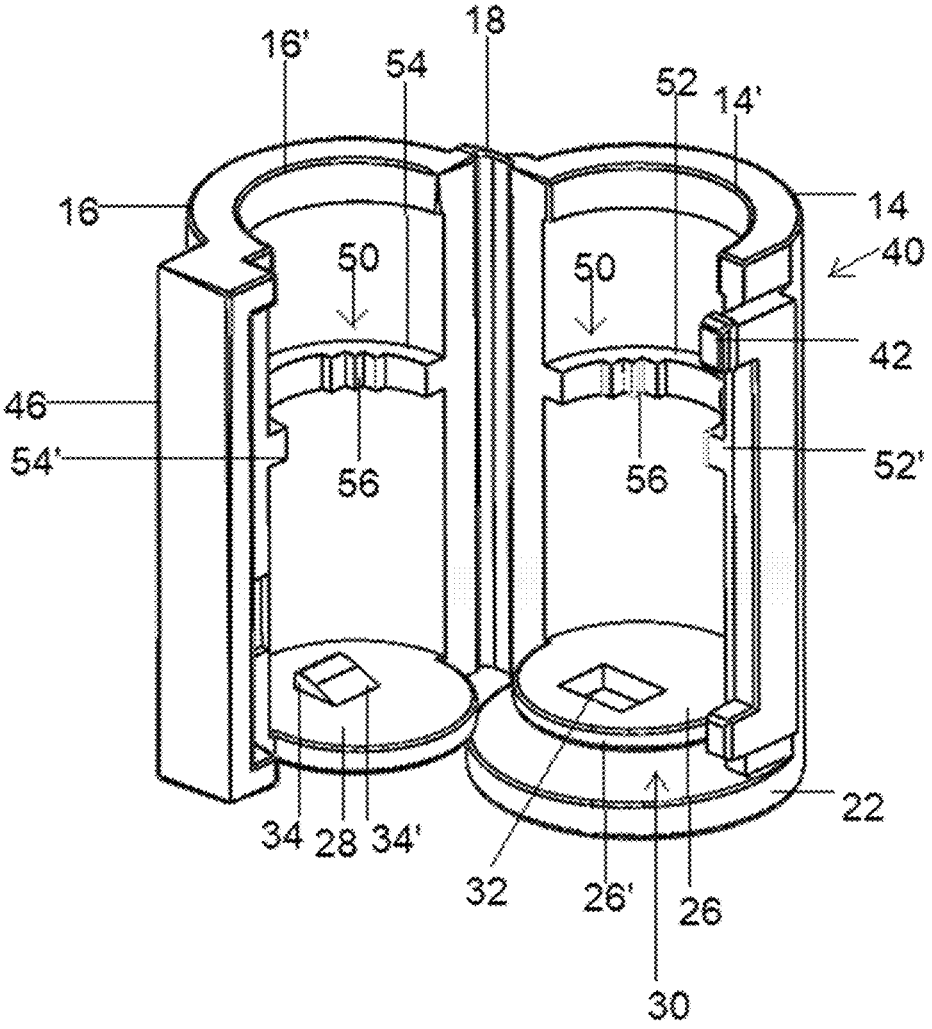
FIG. 4 is a perspective view of the embodiment of FIGS. 1-3 in an open but at least partially closing orientation.

The ramp configuration/construction 34' of the locking component 34 facilitates receipt and sliding engagement of the locking component 34 relative to the first lock member 26 and or the leading edge 26' thereof, as the second lock member 28 passes into the predetermined space 30, as at least partially represented in FIG. 4. Such a sliding engagement/fit may be necessary due to the close tolerances in the thickness dimension of the second locking member 28 and that of the predetermined space 30, as indicated above.

When the housing 12 is in the closed orientation, the open end 14' and 16' of each of the housing segments 14 and 16 collectively define the access opening 20 of the housing 12. The access opening 20 is dimensioned and disposed to receive the container port 200 (see FIG. 5) while the container port 200 is disposed at least partially within the interior 12' of the housing 12 in attached relation to the port closure 100. As should be apparent, the hinged or pivotal connection 18 between the housing segments 14 and 16, define a "clamshell" configuration/structure. In turn, this facilitates the container port 200 and attached closure 100 being inserted within the interior 12' of the housing 12, while the housing segments 14 and 16 are in the open orientation. When the closure 100 and port 200 are so inserted, disposition of the housing segments 14 and 16 in the closed orientation will result in capture of the closure 100 within the housing, as explained in greater detail hereinafter. Concurrently, the additive port or other proof 200 of the container, to which the closure 100 is attached, will also be enclosed.

The structural features of the housing 12 also include a retaining assembly 50 disposed at least partially within the hollow interior of at least one of the housing segments 14 or 16. However, preferably and possibly more practically, the retaining assembly 50 will be disposed within the hollow interiors 14' and 16' of both of the two housing segments 14 and 16. As such, the retaining assembly 50 includes at least one but preferably at least two retaining flanges or flange segments 52 and 54. Each of the at least two retaining flanges 52 and 54 is integrally or otherwise fixedly secured to the interior surface of the hollow interior 14' and 16' of different ones of the housing segments 14 and 16. Further, the retaining flanges 52 and 54 extend transversely outward from the respective interior surfaces into aligned substantially mating and/or confronting and/or coplanar relation to one another, as at least partially represented in FIG. 4. Such substantially aligned, mating engagement may be at least partially defined by corresponding ends 52' and 54' of the respective flange segments 52 and 54 being disposed in confronting, contiguous or at least immediately adjacent relation to one another. Such substantially aligned relation may also be defined by the at least two retaining flange segments 52 and 54 being in substantially coplanar relation to one another.

The cooperative disposition, dimension and configuration of the flange segments 52 and 54 are such as to form a substantially annular or ring-like configuration including a central opening or aperture 55 extending through the mated and/or confronting retaining flange segments 52 and 54. The transverse dimension or dimension of the diameter of the retaining opening or aperture 55 is dependent on the corresponding dimension of the closure 100 and/or port 200. More specifically, once the two housing segments 14 and 16 are disposed in the closed orientation, the closure 100 is captured within the interior 12' of the housing 12, between the mating or confronting retaining flanges 52 and 54 and the first lock member 26 and/or base 22.

Yet additional structural features of the two retaining flanges include the inner peripheral edge thereof having an irregular surface configuration, as at 56. This irregular surface configuration 56 may be defined by a plurality of teeth extending along at least a portion of the length of the inner peripheral edge 52' and 54'. As such, the irregular surface configuration 56 is disposed in surrounding, retaining and possibly confronting relation to a corresponding portion of the container port 200, to which the closure 100 is attached. The plurality of teeth or other irregular surface configuration 56 may be disposed and structured to provide a gripping engagement with the container port 200. As such, a forced removal of the shield 10 and/or housing 12 would result in a possible damaging of the container port 200 due to engagement with the plurality of teeth or other irregular surface configuration 56.

As indicated, the captured disposition of the closure 100, is at least partially accomplished by the retaining opening or aperture 55 having a smaller transverse dimension or diameter than that of the closure 100. As a result, passage of the closure 100 through the retaining aperture 55 and out of the access opening 20 of the housing 12, once the housing segments 14 and 16 are in the closed orientation is prevented. As a result, removal of the housing 12 from the closure 100 or container port 200 will result in a removal of the closure 100 from the port 200 of the container and the capture of the closure 100 within the interior 12' of the closed housing 12. Therefore, the closure 100, once captured within the interior of the housing 12', will be non-accessible due to the two housing segments 14 and 16 being fixedly secured, in the closed orientation and one end of the housing 12 being closed by base 22. This non-accessibility is also due to the closure 100 not being able to pass through the retaining opening or aperture 55 in the retaining assembly 50. Also, as represented in FIG. 5, when the closure 100 is captured within the interior of the housing 12' the lock assembly 25, including the locking components 32 and 34 will be non-accessible and non-observable, such as through the access opening 14, due to the position and dimensions of the closure 100 relative thereto.

Additional structural and operative features of one or more preferred embodiments of the shield 10 include the provision of a latch assembly 40 fixedly mounted on or connected to the free longitudinal sides of each of the two housing segments 14 and 16. Moreover, the latch assembly 40 is at least partially disposed on the exterior of the housing 12 and comprises one or more cooperatively structured latch structures 42 and 44, which serve to retain the two housing segments 14 and 16 in the closed orientation. Similarly, latch assembly 40 may also include oppositely disposed latch structures 42' and 44' disposed adjacent an end of the housing 12 opposite to the access opening 20.

In more specific terms, latch structure 42 comprises an outwardly extending finger which may have a hook or other type of retaining configuration disposed dimensioned and configured to pass through latch structure 44 in the form of a receiving aperture. Also, an outwardly extending border or like structure 46 is disposed in overlying at least partially covering relation to the latch structures 42 and 44, when disposed in mating, latched relation to one another. The protective border 46 is disposed and structured to restrict access to the latch structures 42 and 44, when in their latched engagement with one another. It is also to be noted that the latch structures 42 and 44 of the latch assembly 40 may be disposed at the substantially opposite end of the housing 12 relative to the first and second lock members 26 and 28 of the lock assembly 25. Such a spaced relation therebetween provides an increased leverage which facilitates maintenance of the housing 12 fixedly secured in the closed orientation.

Therefore, one or more preferred embodiments of the shield 10 includes both the interior, non-accessible lock assembly 25, as described above, as well as the provision of an additional latch assembly 40. Moreover, the latch assembly 40 is structured to independently restrict opening or separation of the two housing segments 14 and 16 into the open orientation once disposed in the closed orientation.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A shield for a closure of a medical container comprising:

a housing including two housing segments movably connected together and disposable between an open orientation and a closed orientation, each of said two housing segments including an at least partially hollow interior and an open end, said open ends defining an access opening of said housing, concurrent to said closed orientation, a lock assembly mounted on each of said two housing segments at least partially within corresponding ones of said hollow interiors thereof; said lock assembly disposed in a non-accessible location, concurrent to said closed orientation, and said lock assembly structured to define a fixed locked connection of said two housing segments in said closed orientation, and a latch assembly connected to a free longitudinal side of each of said housing segments and movable therewith between said open orientation and said closed orientation; said latch assembly structured to retain said housing segments in said closed orientation.

2. The shield as recited in claim 1 wherein said latch assembly comprises at least one latch structure connected to said two housing segments in a latched orientation adjacent said open end of said housing, concurrent to said fixed locked connection.

3. The shield as recited in claim 1 further comprising tamper evident capabilities at least partially defined by permanent disposition of said housing segments in said closed orientation, via said fixed locked connection.

4. The shield as recited in claim 1 further comprising a living hinge pivotally interconnecting said two housing segments along correspondingly disposed longitudinal sides thereof.

5. A shield for a closure of a medical container comprising:

a housing including two housing segments movably connected together and disposable between an open orientation and a closed orientation, each of said two housing segments including an at least partially hollow interior and an open end, said open ends defining an access opening of said housing, concurrent to said closed orientation, a lock assembly mounted on each of said two housing segments at least partially within corresponding ones of said hollow interiors thereof; said lock assembly disposed in a non-accessible location, concurrent to said closed orientation, said lock assembly structured to define a fixed locked connection of said two housing segments in said closed orientation, a retainer comprising at least two retaining flanges each connected to and extending outwardly from an inner surface of a different one of said hollow interiors of said housing segments in a capturing orientation relative to the closure, concurrent to said closed orientation, and each of said retaining flanges including an irregular interior peripheral surface disposed in retaining, confronting relation to a port of the medical container, concurrent to said closed orientation.

6. The shield as recited in claim 5 wherein said capturing orientation comprises said at least two retaining flanges collectively disposed in at least partially surrounding relation to the port of the medical container and in interruptive relation to the closure, relative to said access opening.

7. The shield as recited in claim 5 wherein said capturing orientation further comprises said at least two retaining flanges disposed in substantially aligned, mating relation to one another intermediate said access opening and an opposite end said housing and in capturing relation to the closure, concurrent to said closed orientation.

8. The shield as recited in claim 7 wherein said capturing orientation further comprises said retainer and a base of said housing disposed on opposite sides of the closure, concurrent to said closed orientation.

9. A shield for a closure of a medical container comprising:

a housing including two housing segments movably connected together and disposable between an open orientation and a closed orientation, each of said two housing segments including a hollow interior and an open end, said open ends defining an access opening of said housing, concurrent to said closed orientation, a base connected to and movable with one of said two housing segments in outwardly extending relation from said hollow interior thereof; said base at least partially defining a closed end of said housing, concurrent to said closed orientation, a lock assembly including a first lock member and a second lock member each connected to said hollow interior of a different one of said two housing segments, a first locking component and a second locking component respectively disposed on said first lock member and said second lock member, said closed orientation comprising said first and second lock members disposed in co-axial alignment with one another and collectively in coaxial relation to a length of said housing, and said closed orientation further comprising said first and second locking components disposed in a fixed locked engagement and non-accessible, non-observable location within said housing.

10. The shield as recited in claim 9 wherein said base is disposed in co-axial alignment with said first and second lock members, concurrent to said closed orientation.

11. The shield as recited in claim 9 further comprising said first lock member connected to said one housing segment in spaced relation to said base; said second lock member connected to the other of said two housing segments and extending outwardly therefrom, between said first lock member and said base and into said fixed locked connection, concurrent to said closed orientation.

12. The shield as recited in claim 11 wherein said second lock member is connected to one end of said other housing segment, opposite to said open end thereof, in an offset alignment with said first lock member and said base.

13. The shield as recited in claim 11 wherein said base is disposed in stabilizing relation to said second lock member, concurrent to said closed orientation, said stabilizing relation comprising said base and said first and second lock members disposed in said co-axial alignment with one another.

14. The shield as recited in claim 9 wherein one of said first and second locking components comprises a ramp structure and the other of said first and second locking components comprises an opening; said opening cooperatively disposed and dimensioned to fixedly receive said ramp structure therein, concurrent to said closed orientation.

15. The shield as recited in claim 14 wherein said ramp structure is disposed sliding engagement with said first lock member into a fixed disposition within said opening concurrent to passage of said second lock between said first lock member and said base, and said two housing segments into said closed orientation.

* * * * *